United States Patent [19]

Ross

[11] Patent Number: 4,630,794

[45] Date of Patent: Dec. 23, 1986

[54] SOAP HOLDER AND DISPENSER

[76] Inventor: Rodger L. Ross, P.O. Box 30, Alleyton, Tex. 78935

[21] Appl. No.: 688,554

[22] Filed: Jan. 3, 1985

[51] Int. Cl.[4] ..... A47K 5/08

[52] U.S. Cl. ..... 248/309.1; 312/351; 312/35; 312/319; 206/77.1; 221/189

[58] Field of Search ..... 248/309.1, 311.2, 314; 4/628, 546, 597; 241/602; D6/532; 221/281, 188, 189; 232/43.1, 64–66; 206/77.1; 312/351, 35, 319

[56] References Cited

U.S. PATENT DOCUMENTS

| | | | |
|---|---|---|---|
| 2,504,536 | 4/1950 | Kisselberg | 206/77.1 |
| 2,821,807 | 2/1958 | Simmons | 206/77.1 |
| 2,879,622 | 3/1959 | Graziano | 206/77.1 |
| 3,054,211 | 9/1962 | Hawk | 232/43.1 |
| 3,343,774 | 9/1967 | Pryor | 4/628 |
| 4,313,537 | 2/1982 | Collet | 248/309.1 |
| 4,435,030 | 3/1984 | Haven | 206/77.1 |
| 4,527,764 | 7/1985 | Krause | 206/77.1 |

FOREIGN PATENT DOCUMENTS

| | | | |
|---|---|---|---|
| 589295 | 12/1959 | Canada | 221/189 |
| 1225910 | 9/1966 | Fed. Rep. of Germany | 221/189 |
| 1290315 | 3/1969 | Fed. Rep. of Germany | 312/351 |
| 405212 | 2/1934 | United Kingdom | 221/189 |
| 670290 | 4/1952 | United Kingdom | 206/77.1 |
| 931264 | 7/1963 | United Kingdom | 221/189 |
| 2060374 | 5/1981 | United Kingdom | 206/77.1 |

*Primary Examiner*—J. Franklin Foss
*Assistant Examiner*—Robert A. Olson
*Attorney, Agent, or Firm*—Arnold, White & Durkee

[57] ABSTRACT

This invention is a container for holding and semi-automatically dispensing a bar of soap. The soap is placed in the container through an opening in the top. A pivotally connected enclosure positions the soap on a holding shelf and shelters the soap from direct and indirect contact with water. The shelf, which may have an open grid-like surface, has at least one drain, allowing water to drain from the soap and not pool and collect around the soap. When the soap is needed, the user mechanically operates the container. The enclosure pivots, pushing the soap semi-automatically to an exit opening, where the soap dispenses from the container into the hand of the user. The container may be used in any facility requiring the use of soap and particularly in bath tubs and showers. The container may be attached by a bracket to a wall or other mounting surface.

12 Claims, 6 Drawing Figures

SOAP HOLDER AND DISPENSER

This invention pertains to a soap holder and dispenser. It pertains more particularly to a soap holder and dispenser which allows water to drain from the soap and its surroundings, reduces water damage to the soap, and also provides ready semi-automatic access to the soap.

BACKGROUND OF THE INVENTION

When soap is contacted with water, the water softens and dissolves the soap to form a lather. When soap is used in showers, the shower water contacts the soap not only during use, but also while the soap is awaiting use on a convenient surface or in a soap receptable. While so positioned on a soap tray or other receptacle, the soap may be struck by shower water either directly from the shower spray or indirectly by water directed into the receptacle. The water thus contacting the soap's surface deteriorates and gradually dissolves the soap. The water may also collect and pool beneath and around the soap bar. This latter condition further continues the dissolving action on the soap. Often a layer of watery soap forms on the bar of soap, and this layer easily separates from the soap when it is picked up and used. This causes further dissolution and loss of the soap.

Various devices and articles have been used to provide convenient access to a soap bar, while minimizing the adverse effects shower water has on the soap. Many showers and baths of today, for example, have ceramic tile receptacles or recesses in the wall of the shower or bathtub area. These recesses frequently have a bottom with several ribs raised in the surface. The ribs support the soap and help to keep it away from puddled water which accumulates by draining directly from the soap, or which collects in the recesses from water sprayed or splashed into the recesses. In either case, quantities of water collect and pool around the bottom of the soap sitting on the ridges, thereby causing the soap to dissolve and deteriorate.

U.S. Pat. No. 1,491,953 describes a soap holder formed in the side of a sink, wash basin or the like. A water drainage pipe connects the soap holder receptacle to the sink drain. Water spraying or splashing into the receptacle or dripping from the soap flows to an outlet in the receptacle. The pipe connected to this outlet empties into the main sink drain. This system could be cast into a tub or shower when manufactured, or it could be added during building construction. It appears that approach, however, could not be easily retrofitted into existing bathrooms. The system also appears not to shelter soap from water spraying or splashing into the receptacle.

Another early attempt to deal with water splashing into a soap receptacle soap is described in U.S. Pat. No. 1,536,906. The soap dish shown there extends away from the wall to a semicircular open ended gutter which discharges water from the soap dish into a sink or tub. A later patent, U.S. Pat. No. 4,300,248, describes a snap-in dish liner which fits an existing ceramic soap dish recess in a tub or shower. The liner has top and side walls which extend outwardly from the recess for a distance to reduce or restrict water entering the recess and dissolving the soap. These soap receptacles, however, appear not to shelter the soap; nor do they provide for semi-automatic retrieval of the soap.

SUMMARY OF THE INVENTION

The present invention addresses the problems of soap deterioration by water contact, particularly in a shower or bath tub while the soap is not in use. The invention comprises an improved container with a shelf for holding and sheltering a bar of soap while it awaits use. The container also provides for semi-automatic retrieval of the soap by the user. The container includes a soap enclosure or holding chamber which shelters the soap, and it is envisioned that the container will be used principally in a shower or bath tube where the enclosure will help protect the soap from direct or indirect contact by shower spray while the soap is not in use.

The container also includes a shelf of which the soap sits while in the container. The shelf is designed to direct water, dripping from the soap or otherwise entering the container, into the shower or tub. The present invention accordingly reduces the collecting and pooling of water around and under the soap bar. The shelf design itself may take a variety of forms including a wire grid, a lattice work of cross members, or a ridge and channel plate having at least one drain hole.

The container further incorporates a mechanism to retrieve soap from the container when the user is ready for the soap. When the soap is needed, the container semi-automatical soap mover dispenses the bar of soap directly into the waiting hand of the bather. This soap mover may be an enclosure which pivots to push on the soap, a shelf which moves relative to the enclosure, or a third member which pushes the soap from the container.

The invention may be used in various circumstances. Thus, in addition to its use on the wall of a shower or tub, it may also be mounted on a cabinet or wall near a sink in a kitchen, garage, bathroom or other facility. The invention may also be made portable, so that its advantages may be utilized by a traveller. This portable embodiment would, of course, also be available for use at home. Finally, the invention does not necessarily have to be attached to a wall or cabinet. It may be hung from a fixture, or it may be a self-contained, free-standing device located in any facility wherein bar soap is used.

The soap holder and dispenser may be manufactured and assembled with a variety of materials suitable for service in a watery or humid environment. Among these materials are wood, metal, and plastics. Materials not readily usable may preferably be coated with a water resistant substance. The soap holder may be formed from plastic by injection or other molding process. The soap holder and dispenser may be affixed to a wall by any one of a number of methods including glue, bolts, screws, nails, wire or string hangers, and the like.

BRIEF DESCRIPTION OF THE DRAWINGS

Objects and advantages of the invention will become further apparent upon reading the following detailed description and upon reference to the drawings, in which:

FIG. 1 is an exploded perspective view of the soap holder container showing a mounting bracket and a hopper type enclosure;

DETAILED DESCRIPTION OF THE PREFERRED EMBODIMENT

In a preferred form, the present invention comprises a wall mountable container which includes a wall mounting bracket and a hopper for holding a bar of soap. The soap is surrounded by the hopper which is connected at its upper end to a wall mounting bracket. The hopper pivots around this connection point toward the shower wall. This pivoting action pushes the soap out of the container into the bather's hand.

The container includes a bracket which is adapted to be mounted on a wall. The bracket supports a horizontal shelf having a surface on which the soap sits and drains. This shelf preferably takes the form of an open grid-like lattice, or a shelf having perforations. The shelf is supported by arms or equivalent means extending forward from the mounting bracket and shower wall. An opening between the shelf and the bracket provides an exit for the soap from the container when needed by the bather.

The hopper is preferably rectangular in lateral cross section to accomodate a bar of soap. As described earlier, the hopper connects at its upper end by pins to the mounting bracket. The hopper pivots around these pins towards the shower wall. The hopper is vertically disposed with its lower end positioned over the soap holding shelf. The lower open end of the hopper approaches but does not contact the shelf surface. A front wall on the mounting bracket connects to the front edge of the shelf and extends above the shelf surface.

A resilient springy member connected to the upper end of the mounting bracket extends downwardly and outwardly towards the hopper. The distal end of this member contacts the back wall of the hopper and normally restrains the hopper in a substantially vertical position over the soap shelf.

Soap is placed in the container through an upper opening in the hopper. The hopper communicates with the shelf so as to allow the soap to slide through the hopper and rest on the soap shelf. A canopy or hinged cover may be used to reduce water entry into the container through the upper opening in the hopper.

To retrieve the soap for use, the bather simply pushes on the lower front wall of the hopper. This pivots the lower end of the hopper towards the shower wall. The interior wall of the hopper contacts and pushes the soap towards the opening between the shelf and the back wall of the mounting bracket. The soap moves into register or communication with the opening and falls through the opening into the bather's hand. When the bather stops pushing on the hopper, the resilient member returns the hopper to its normal substantially vertical position over the soap shelf. The mounting bracket front wall extending above the shelf surface acts as a stop for the hopper.

Figure 1A:
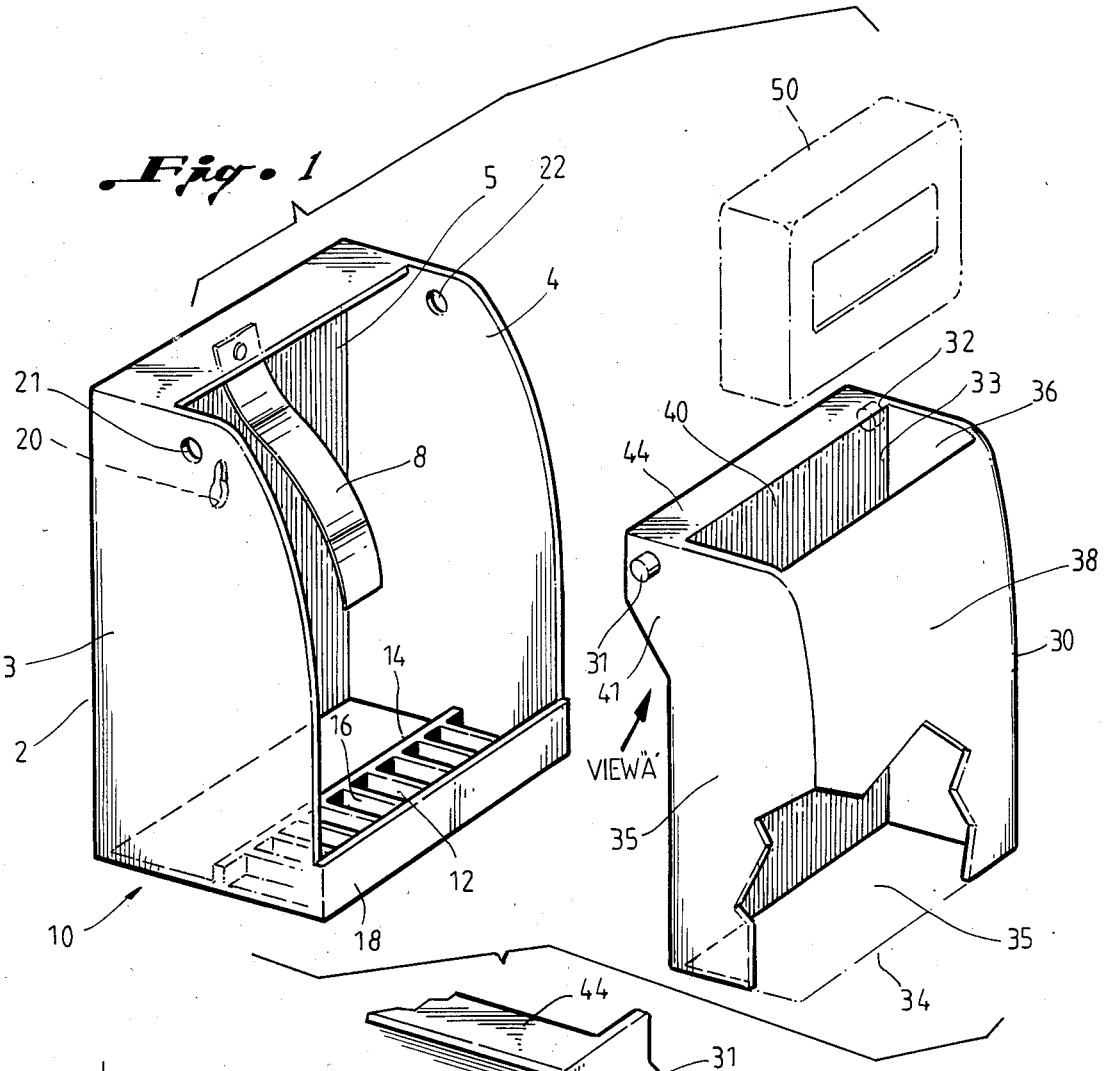
FIG. 1A is a perspective detail view of the soap holder container showing the flange at the top of the hopper from which extends a pivot pin.
Figure 1A:
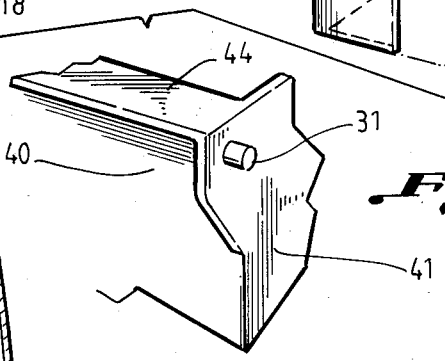

As may be seen in FIG. 1, a preferred embodiment of the present invention comprises a soap holding hopper 30 which pivotally connects to a wall mounting bracket 2. Bracket 2 has parallel side walls 3 and 4. The back wall 5 extends laterally between the side walls 3 and 4, and connects to side walls 3 and 4 along their back edges. Top brace 6 similarly extends between the side walls 3 and 4, and interconnects along the upper edges of the side walls 3 and 4 and the upper edge of the back wall 5. Hopper stop member 18 extends laterally between the side walls 3 and 4 and parallels the back wall 5. Stop member 18 connects to the front edges of side walls 3 and 4. For ease in manufacture and assembly, the mounting bracket walls may be integrally joined together to form a housing for pivotally suspending enclosure 30. An alternative embodiment can use a bracket having interconnected support members in a structural framework. For instance, the back panel can be replaced with upper and lower lateral support members and diagonally crossing members for structural support.

The soap shelf 12 has a lattice work structure. The shelf 12 has a side support member 14 and a plurality of cross members 16. Side support member 14 extends between the side walls 3 and 4, parallel to back wall 5, and is located about midway between the front and back edges at the lower ends of side walls 3 and 4. A plurality of cross members 16 extend in uniformly spaced relationship from the interior surface of stop member 18 to the support member 14. These cross members integrally connect with the side support member 14 and the stop member 18. The stop member 18 is positioned adjacent to the shelf and extends above it, forming a wall on the outer edge of the shelf. This wall provides a stop for the soap hopper which is held in a substantially vertical position over the shelf by the resilient member 8. Member 8 may be a leaf spring or similar resilient member to exert force on the hopper 30 to restrain it in its normal forward position. It will be appreciated that the shelf may be integrally formed with the mounting bracket.

Aperture 20 in the back wall 5 provides an opening through which a wall mounting screw may be inserted. As may be appreciated, a variety of holding means may be used to affix the mounting bracket to a bathtub or shower wall. Thus, means such as suction cups, glue, nails and the like may also be used to connect the mounting bracket to a shower wall. Still another embodiment has a loop shaped member extending from the top corner where side wall 3 and back wall 5 join, to the related corner where side wall 4 and back wall 5 join. This loop member can be used to straddle a shower nozzle pipe to support the soap holder container. The loop may be formed of metal, plastic, fabric materials, or the like.

Resilient or spring member 8 is connected at its upper end to the back wall 5, and may be formed integrally as part of the back wall 5. As may be seen more clearly in FIG. 2, resilient member 8 extends downwardly and outwardly from the back wall. Member 8 slidably engages the exterior of back wall 40 of soap hopper 30, and acts to hold hopper 30 in a substantially vertical position over the soap shelf.

Figure 2:
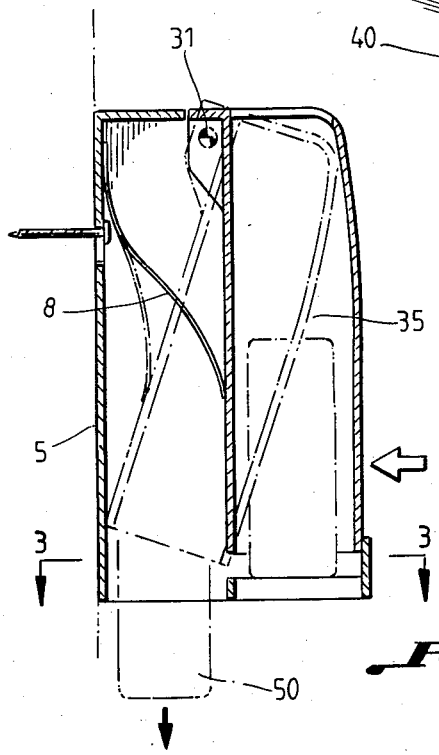
FIG. 2 is a cross-sectional side view of the soap holder container including the hopper shown pivoted towards the shower wall.

The soap hopper 30, as seen in FIGS. 1 and 2, has side walls 36, front wall 38 and back wall 40. These receptacle walls define a vertically positioned rectangular tube. The opening 33 at its upper end is designed to receive a bar of soap, and an exit orifice 34 at its lower end is designed to pass the bar of soap. Thus, the hopper 30 is both a rectacle and a shelter for the soap. Flanges 41 (shown) and 42 (not shown) extend from the sides 35 and 36 at the hopper's upper end. Top flange 44 connects along the upper edges of flanges 41 and 42. Pins 31 and 32 project from the exterior surface of flanges 41 and 42. These pins pivotally engage bearing seats 21 and 22 to rotatably suspend the hopper from the mounting bracket 2.

It will be apparent that other means may be employed to effect the pivotal connection between the hopper 30 and mounting bracket 2. For example, pins 31 and 32 could project from side walls 3 and 4, and engage bearing seats in hopper side walls 35 and 36. Also, a pivot shaft can extend from walls 3 and 35 through walls 36 and 4 and have brad-like means to secure the shaft ends on the exterior of walls 3 and 4. In any case, occasional cleaning of the soap hopper and soap shelf is simplified by using pins and bearing seats on the side walls of the mounting bracket and soap hopper.

In a preferred embodiment, side walls 3 and 4 are made flexible to be flexibly bent outwardly for insertion and removal of hopper 30. Upon installation of the hopper in the mounting bracket by insertion of pins 31 and 32 in seats 21 and 22, the resilient member 8 engages the enclosure back wall 40. Member 8 pushes against the lower portion of back wall 40, and thereby maintains the soap hopper 30 vertically positioned substantially over the soap shelf 12. When so positioned, the walls of the hopper 30 combined with the surface of the soap shelf 12, form a repository chamber 35 for the stop 50.

It will be noted, as shown in FIG. 2, that there is a gap between the top surface of the shelf 12 and the bottom edges of the soap hopper 30. This gap allows the hopper to freely pivot towards the wall of the shower without the front bottom edge of the hopper scraping the top surface of the shelf.

Figure 3:
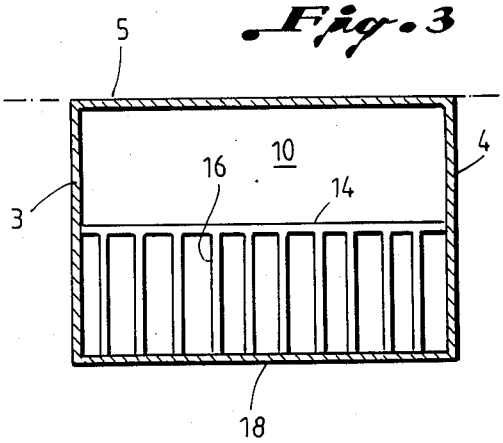
FIG. 3 is a view taken along the section line 3—3 of FIG. 2, showing the soap shelf supported by a centrally disposed side support member between the lower edges of the mounting bracket side walls.
Figure 4:
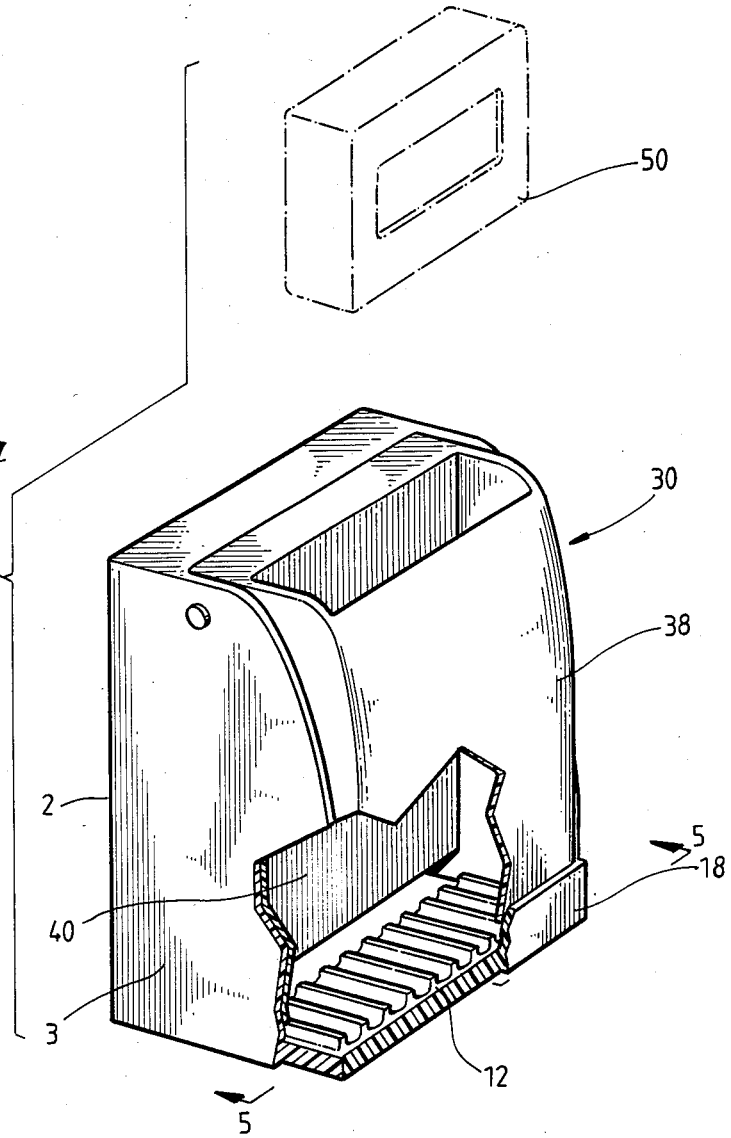
FIG. 4 illustrates an alternate soap drain shelf having ridges and channels for supporting soap and draining water.
Figure 5:
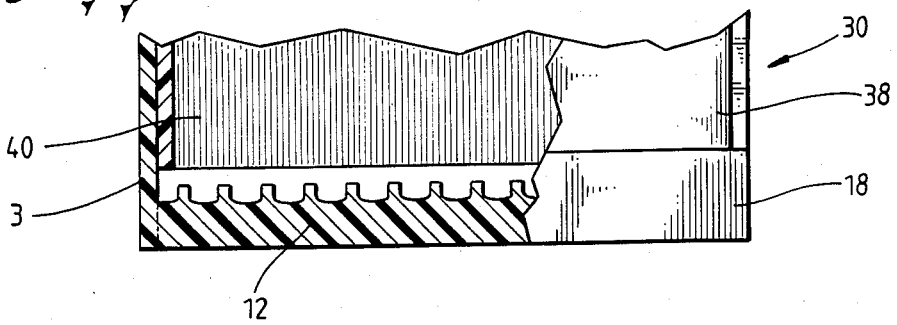
FIG. 5 is a cross section view of an alternate soap drain shelf taken along the line 5—5 in FIG. 4.

A preferred embodiment of the shelf 12 is shown in FIG. 3. A plurality of uniformly spaced lattice cross members 16 connect with the support member 14 to form a grid or lattice upon which the soap may rest. Water drains off the soap and into the shower because the cross members are spaced apart from each other. An alternative embodiment illustrated in FIGS. 4 and 5 substitutes a ridge and channel plate for the lattice shelf. This plate has a series of ridges for supporting the soap. Channels between the ridges direct water from the soap into the shower or bath tub. Still another embodiment of the shelf has perforations for drainage of water into the tub.

As described previously, the support member 14 is positioned about midway between the front of the mounting bracket 2 and the back wall 5. Thus, the support member 14, together with the side walls 3 and 4 and back wall 5, define an exit opening 10 in the bottom of the mounting bracket 2. This provides an opening through which a bar of soap 50 may exit the holder container into the bather's hand.

With reference to FIG. 2, the operation of the soap holder container may now be fully appreciated. The mounting bracket 2 is first affixed, by one of a variety of means, to the wall of a shower or bathtub. The soap hopper 30 is then inserted into the mounting bracket 2. In a preferred embodiment, side walls 3 and 4 are flexibly bent outwards while the hopper 30 slides into place and pivot pins 31 and 32 engage pin bearing seats 21 and 22.

With the mounting bracket and hopper installed on the wall, the soap holder container may then be used. Soap is placed in the chamber 35 by introduction through the top opening 33. The soap drops within the chamber 35 defined by the walls of the hopper 30 to rest upon the soap shelf 12. The shelf allows water to drain from the soap surface back into the shower or tub.

To retrieve the soap 50 for further use, the bather pushes on the lower portion of the hopper front wall 38. This moves the soap hopper 30 from its forward position back towards the shower wall. The interior side of front wall 38 pushes on the soap. The soap slidably moves along the shelf surface, gradually becoming positioned over the exit opening 10. As the soap continues to move over the opening, the soap finally exits the repository chamber 35 and falls into the bather's hands. The bather then stops pushing on the soap hopper, and the spring-like resilient member 8 pushes the hopper from this second position back to its original position over the shelf. Thus, it is seen that the hopper, open at its top and bottom, is pivotally suspended from the mounting bracket. The hopper 30 is normally restrained with its lower end above the soap shelf 12, but may swing from this forward position to a second back position with its bottom opening 34 over the opening 10 between the shelf and the shower wall.

An alternative embodiment of the invention switches the position of the shelf 12 and the soap exit opening 10. This embodiment has the shelf adjacent to back wall 5 with the soap exit opening on the shelf side away from the back wall. The resilient member 8 in this embodiment is a helical spring which pulls the hopper 30 towards back wall 5 to hold the hopper over the shelf. The bather obtains the soap resting on the shelf by pulling on a knob attached to the front wall of the hopper. As with the preferred embodiment, the interior wall of the hopper moves the soap off the shelf towards the soap exit opening. The soap exits the container through the opening 10 into the bather's hand.

While the invention has been described in connection with a mounting bracket defining a housing with side and back panels, one skilled in the art will appreciate that the invention is not so necessarily limited. A framework of interconnecting support members will provide the necessary structure from which the soap hopper may be suspended. The back panel, for instance, can be replaced with upper and lower lateral members with diagonally crossing members for structural support. Also, the invention may be embodied in a portable container for use while travelling. This container will have appropriate sealable covers to guard against leakage from the container while in transit. A permanently mounted connector in the shower area supports the portable embodiment allowing its use at home.

In keeping with the spirit of this invention, one of ordinary skill in the art may further appreciate that the soap mover utilized in this invention does not necessarily have to be a pivoting means as shown in a preferred embodiment. An alternative embodiment for the soap mover has a slidable shelf which may be pulled out from the container. The soap, sitting on the surface of the shelf, contacts the inner wall of the soap enclosure. As the shelf emerges from the front of the container, the soap slidable moves along the surface until the soap, no longer supported by the shelf surface falls through an opening in the bottom of the enclosure. The soap mover could also be at least one rod which pushes on the soap to move the soap over and out the soap exit opening.

To further meet the objectives of this invention, a shroud or cover can close the upper opening 33. This measure helps to keep water from spraying or splashing into the repository chamber 35 and continuing to dissolve the soap.

Thus, it is apparent that there has been provided, in accordance with the invention, a soap holder container that fully satisfies the features and advantages set forth above. While the invention has been described in conjunction with specific embodiments thereof, it is evident that many alternatives, modifications, and variations will be apparent to those skilled in the art in light of the foregoing disclosure. Accordingly, it is intended to embrace all such alternatives, modifications, and variations as fall within the spirit and broad scope of the appended claims.

What is claimed is:

1. A bar soap holder and dispenser, comprising:

a support bracket having a back panel adapted to be mounted to a wall surface, two side panels, a front panel, and a horizontally disposed drain shelf extending between said side panels for supporting a bar of soap, said back panel and the back edge of said drain shelf defining an opening adjacent to said shelf for the passage of said soap;

a hopper in a first forward position stopped by said front panel, adapted to receive and position said soap on said shelf and to shelter said soap; and said hopper supported by said bracket in movable relation with respect to said bracket to enable said hopper to move from said first position over said shelf to a second position over said opening, for pushing said soap off said drain shelf through said opening.

2. A bar soap holder and dispenser as recited in claim 1, wherein said hopper is substantially rectangular tube oriented vertically over said shelf, open at both its upper and lower ends, and supported at its upper end by said bracket.

3. A bar soap holder and dispenser as recited in claim 2, including pin means connected to the upper end of said hopper and journalled in said bracket such that the lower end of said hopper may pivot from a first position over said shelf to a second position over said opening for pushing said soap over said opening.

4. A bar soap holder and dispenser as recited in claim 3, further comprising a resilient return member for resiliently returning said hopper to a substantially vertical position over said shelf after said hopper has pivoted from said first position to said second position.

5. A bar soap holder as recited in claim 4, wherein said return member is a leaf-spring interposed between said hopper and said support bracket.

6. A bar soap holder as recited in claim 5, wherein said shelf is a lattice structure.

7. A bar soap holder as recited in claim 5, wherein said shelf is a plate having ridges upon which said soap sits and channels between said ridges for draining water from said soap.

8. A soap holder mountable on the wall of shower or bath tub, comprising:

a mounting bracket including two laterally spaced parallel arms extending perpendicularly forward from said bracket and a vertically disposed front panel connecting the distal ends of said arms;

a laterally disposed soap support member positioned between said arms and attached to said arms along the lower edge of said arms from said distal ends to a point medial said distal ends and said mounting bracket, said arms and support member defining an opening, said support member adapted for draining water freely from said soap into said shower or tub;

a vertically disposed tube, open at its upper end to receive said soap and lower end to pass said soap, pivotally supported from said bracket to pivot between a first position with said lower end substantially above said soap support member and adjacent to said front panel so that the interior walls of said tube and said support member define a soap holding chamber, and a second position with said lower end substantially over said opening behind said soap support member and between the proximal ends of said parallel arms; and an elastic member interposed between said mounting bracket and said tube such that when said tube pivots towards said bracket in response to a force directed towards said bracket on the exterior front wall of said tube, said elastic member compresses and when said force is removed, said elastic member returns said tube to its first position over said soap support member.

9. A soap holder mountable on the wall of a shower or bath tub, as recited in claim 8 wherein:

said mounting bracket is adapted to be mounted on a wall;

said support member is an open grid-like lattice;

said tube is a hopper; and said elastic member is connected at the upper end of said mounting bracket and extends downwardly and outwardly, said elastic member's distal end contacting the back wall of said hopper.

10. A soap holder and dispenser, comprising:

a housing having a vertically disposed back panel adapted to be mounted on a wall surface, two side panels, and a bottom panel spanning a front portion of the bottom of said housing, the back edge of said bottom panel defining an opening in said housing;

a hopper having a substantially rectangular cross section, open at its top and bottom, pivotally suspended within said housing to swing between a forward position with said hopper bottom opening above said bottom panel and a back position with said hopper bottom opening over said housing opening;

a vertically disposed front panel laterally extending between said side panels and extending above the upper surface of said bottom panel a sufficient distance to form a hopper return stop; and spring means interposed between said housing and said hopper biased to urge said hopper into said forward position.

11. A soap holder and dispenser, as recited in claim 10, wherein said bottom panel is a lattice structure.

12. A soap holder and dispenser, as recited in claim 10, wherein said bottom panel is a plate having ridges upon which said soap sits and channels between said ridges for draining water from said soap.

* * * * *